US011217064B2

(12) United States Patent
Idom

(10) Patent No.: US 11,217,064 B2
(45) Date of Patent: Jan. 4, 2022

(54) INTERACTIVE CASINO SYSTEM AND METHOD OF REDEEMING CASINO VOUCHERS

(71) Applicant: Tyler Idom, Perris, CA (US)

(72) Inventor: Tyler Idom, Perris, CA (US)

( * ) Notice: Subject to any disclaimer, the term of this patent is extended or adjusted under 35 U.S.C. 154(b) by 0 days.

(21) Appl. No.: 16/990,438

(22) Filed: Aug. 11, 2020

(65) Prior Publication Data

US 2021/0142616 A1 May 13, 2021

Related U.S. Application Data

(60) Provisional application No. 62/933,603, filed on Nov. 11, 2019.

(51) Int. Cl.
*G07F 17/32* (2006.01)

(52) U.S. Cl.
CPC ..... *G07F 17/3244* (2013.01); *G07F 17/3223* (2013.01)

(58) Field of Classification Search
CPC ..... G07F 17/3223; G07F 17/3239; G07F 17/3255; G07F 17/3244
See application file for complete search history.

(56) References Cited

U.S. PATENT DOCUMENTS 8,024,242 B2 9/2011 Galit
8,583,515 B2 11/2013 Sorbe et al.
8,684,265 B1 * 4/2014 McGhie ..... G06Q 20/381 235/380
8,992,305 B2 3/2015 Sanford et al.
9,495,808 B2 11/2016 Jenrick et al.
10,062,062 B1 * 8/2018 McGhie ..... G07F 19/20
2003/0162591 A1 * 8/2003 Nguyen ..... G07F 17/32 463/29
2003/0171145 A1 * 9/2003 Rowe ..... G07F 17/32 463/25
2010/0082470 A1 4/2010 Walach et al.
2010/0250355 A1 * 9/2010 McInnes ..... G06Q 30/0215 705/14.18
2018/0005486 A1 * 1/2018 Risnoveanu ..... G06Q 20/207
2019/0122481 A1 * 4/2019 Risnoveanu ..... G07F 17/32
2019/0213832 A1 * 7/2019 Tsutsui ..... G06Q 30/0201
2019/0272704 A1 * 9/2019 LeMay ..... G07F 17/3251

* cited by examiner

*Primary Examiner* — Steve Rowland
(74) *Attorney, Agent, or Firm* — Boudwin Intellectual Property; Daniel Boudwin

(57) ABSTRACT

An interactive casino system and method of redeeming casino vouchers is provided. The interactive casino system has an application on a computing device which is in communication with a database. The application is configured to deposit a currency represented by at least one casino voucher directly into a paired bank account via the database. The application also includes an identification process in the form of scanning a barcode or the like on the voucher. The application further includes a credit building system which can be used to build and store refundable credits on the database after a pre-determined amount of money is spent in a casino. The application similarly comprises a travel point system which can be used to build and store a redeemable travel credit on the database which can be redeemed for a transportation ticket on a paired carrier.

8 Claims, 4 Drawing Sheets

INTERACTIVE CASINO SYSTEM AND METHOD OF REDEEMING CASINO VOUCHERS

CROSS REFERENCE TO RELATED APPLICATIONS

This application claims the benefit of U.S. Provisional Application No. 62/933,603 filed on Nov. 11, 2019. The above identified patent application is herein incorporated by reference in its entirety to provide continuity of disclosure.

BACKGROUND OF THE INVENTION

The present invention relates to casino fund transfer systems. More particularly, the present invention provides for an interactive casino system in the form of an application for a computing device as well as a method for redeeming casino vouchers safely and securely.

Many people travel to casinos to gamble and win large sums of money. Some people visit their local casino often while others plan large, extravagant trips that can involve trains, flights, and rental cars. As a patron of a casino wins, they are presented with a voucher for the amount of currency owed to them by the casino. The patron must then take the voucher to a redemption area of the casino where the vouchers are exchanged for paper and coinage currency. It is then left up to the patron to transport this currency safely and securely to storage, typically in a bank. In some cases, these vouchers can be misplaced, lost, or even stolen prior to reaching the redemption area. The vouchers are typically un-trackable and irreplaceable, meaning that if the voucher falls out of possession of the patron, they have no way of obtaining their winnings.

Additionally, once the patron receives the currency, they typically have to be cautious as they leave the premises as patrons coming and going into and out of casinos are prime targets for thieves. This creates unnecessary danger to the public, including the patrons, bystanders, and even the thieves themselves. Such a dangerous element can also tarnish the reputation of the casino. Patrons may stop frequenting the establishment if they feel that the casino is unsafe. Accordingly, there is a need for an interactive casino system that enables patrons to transfer their winnings safely and efficiently from an account of the casino, as represented by the casino voucher, to an account of the patron. Immediate transfer of said funds is highly desirable as it eliminates the possibility of loss or theft.

The present invention substantially diverges in design elements from the known art and consequently it is clear that there is a need in the art for an improvement to existing casino fund transfer systems. In this regard the present invention substantially fulfills these needs.

SUMMARY OF THE INVENTION

In view of the foregoing disadvantages inherent in the known types of casino fund transfer systems now present in the art, the present invention provides an interactive casino system in the form of an application for a computing device as well as a method for redeeming casino vouchers safely and securely. The present interactive casino system and method of redeeming casino vouchers comprises an application on a computing device which is in communication with a database. The application is configured to deposit a currency represented by at least one casino voucher directly into a paired bank account via the database. The application also includes an identification process in the form of scanning a barcode or the like on the voucher. The application further Includes a credit budding system which can be used to build and store refundable credits on the database after a pre-determined amount of money is spent in a casino. The application similarly comprises a travel point system which can be used to build and store a redeemable travel credit on the database which can be redeemed for a transportation ticket on a paired carrier.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
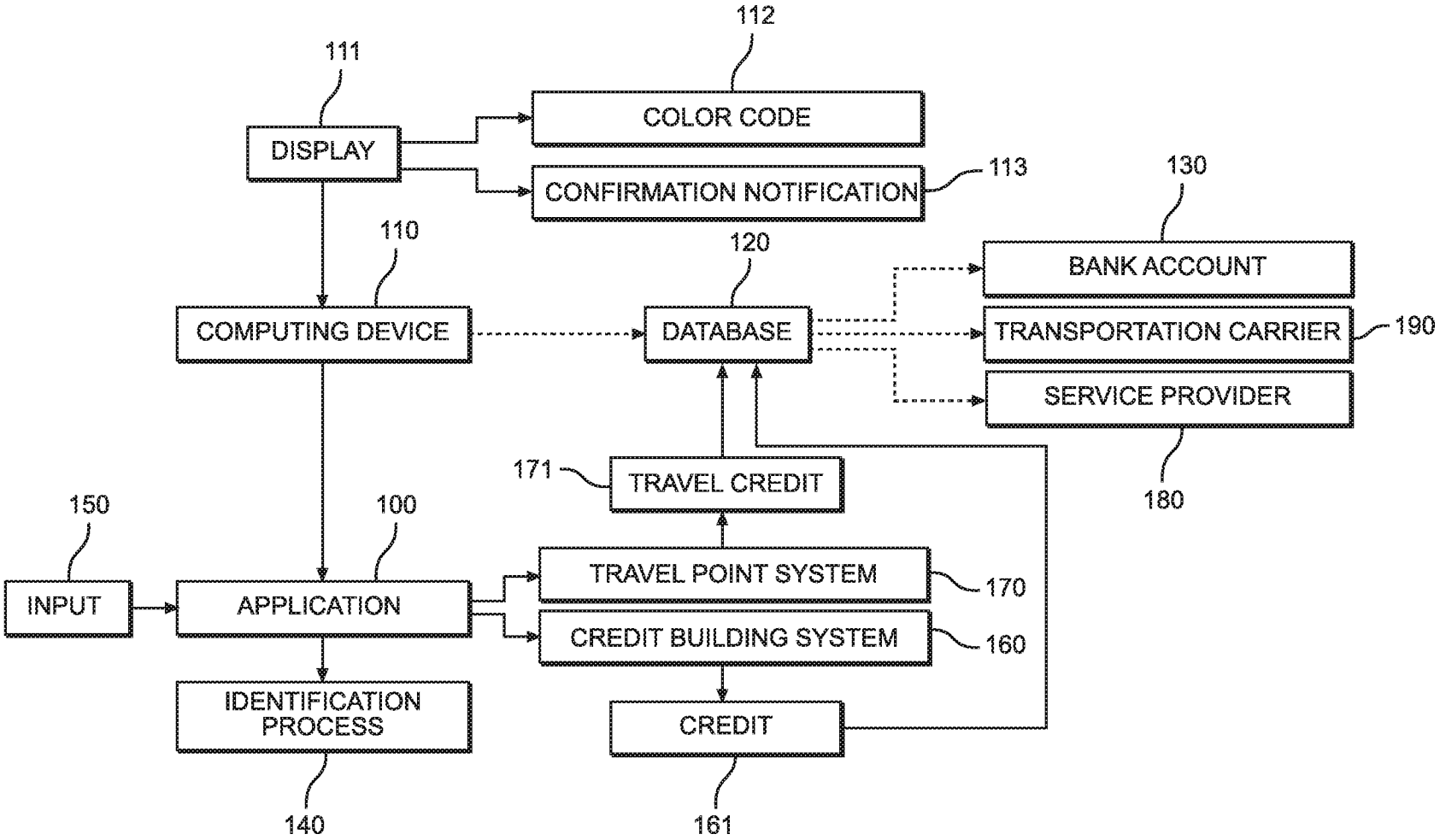
FIG. 1 shows a chart of the representative components of an embodiment of the interactive casino system.

Reference is made herein to the attached drawings. Like reference numerals are used throughout the drawings to depict like or similar elements of the interactive casino system and method of redeeming casino vouchers. For the purposes of presenting a brief and clear description of the present invention, a preferred embodiment will be discussed as used for the interactive casino system and the method of redeeming casino vouchers. The figures are intended for representative purposes only and should not be considered to be limiting in any respect.

Referring now to FIG. 1, there is shown a chart of the representative components of an embodiment of the interactive casino system. The interactive casino system comprises an application 100 on a computing device 110 in communication with a database 120. In various embodiments, the application 100 is configured to run on a variety of computing devices 110 such as a tablet, a cellphone, and a laptop computer. The present application 100 is contemplated to be used in a highly portable computing device 110 such that the application 100 can be run while in a casino or similar establishment. However, the present disclosure also contemplates that such an application 100 can be run on a home computer, public computer terminal, or the like, for the ease of use of a patron of the casino when the patron does not have a highly portable computing device 110 accessible. The computing device 110 includes a display 111 as can be traditionally found on a tablet, cellphone, laptop, or the like, which can present various graphical and textual outputs, or a combination thereof. The application 100 resides in a non-transitory computer readable medium and can run on an operating system. The application 100 includes a user interface and can accept input 150 via the computing device 110 such as through a camera, a touchscreen, or buttons disposed on the computing device 110.

The application 100 is configured to deposit a currency represented by at least one casino voucher directly into a bank account 130 via the database 120. The casino voucher is issued by a participating casino and includes indicia that indicate the amount of currency the casino is to pay to the holder of the voucher. Often, such vouchers include a numerical and textual indication of the amount to be paid, as well as a unique identifier such as a barcode, QR code, or similar short-form code or matrix that can be read by a casino scanner. The application 100 utilizes such indicia, codes, and matrixes in an identification process 140. The identification process 140 can utilize the scanner, camera, or similar component of the computing device 110 to generate an input 150 for the application 100. In one embodiment, the identification process 140 includes scanning the unique identifier of the casino voucher. In a further embodiment, the identification process 140 includes scanning a barcode of the casino voucher. The present disclosure contemplates that said scanning can include taking a picture of the unique identifier with the camera of the computing device 110, as well as utilizing the camera of the computing device 110 to read the unique identifier regardless of whether a picture is taken or not.

In one embodiment, once the voucher is scanned, a color code 112 can be displayed on the display M. The color code 112 corresponds to whether the voucher has been scanned and redeemed or not. For example, in one embodiment, a red color code 112 can be displayed when a voucher is scanner and the voucher has already been redeemed in that the funds have already been paid out by the casino, either in the form of physical currency or by digital transfer such as through the use of the present invention. Similarly, a green color code 112 can be displayed when the voucher has not yet been redeemed.

In one embodiment, the application 100 further comprises a confirmation screen, wherein a positive input from the computing device 110 enables the application 100 to deposit the funds indicated by the casino voucher directly into the bank account 130 via the database 120, as further detailed below. The confirmation screen can provide a readout on the display 111 of the results of the scan to determine the amount of funds to be transferred from the casino to the paired bank account 130. Upon confirmation that the funds are correct, through an input 150 to the application 100, the data transmission between the application 100, database 120, and paired bank account 130 will commence. In a further embodiment, a confirmation notification 113 can be sent to the user upon receipt by the application 100 of a positive response and input 150 to the confirmation screen. In one embodiment, the confirmation notification 113 is displayed via the application 100. In other embodiments, the confirmation notification 113 can be transmitted to an email account, text message to a cellphone, or similar manners of communication.

The application 100 is in communication with the database 120. In one embodiment, the computing device 110 includes a wireless transceiver through which the application 100 can wirelessly transmit data to the database 120. In such an embodiment, the application 100 can be utilized anywhere that a wireless signal is present, either in the form of an internet service provider signal, or a wireless signal that may be available to the patrons of the casino. In another embodiment, the computing device 110 includes a wired port through which the application 100 can transmit data to the database 120. Such a wired port can be utilized when a wireless signal is not available.

In one embodiment, the database 120 is in communication with a paired bank account 130. In such an embodiment, the database 120 can transmit a signal to a banking system at a participating bank such that the database 120 can transmit an authorized allocation of funds from the casino to the paired bank account 130. In such a manner, a user can scan the casino voucher and nearly instantly have the funds deposited in their paired bank account 130. Such a near instant deposit drastically reduces the possibility of lost vouchers, theft of vouchers, lost currency, or theft of currency, thereby providing greatly desired safety and security when transferring funds from the casino. It is contemplated by this disclosure that such transmissions can utilize a variety of cyber security measures and algorithms to ensure that such a transmission of data is protected.

In one embodiment, the application 100 further comprises a credit building system 160, wherein the credit building system 160 builds and stores a refundable credit 161 on the database 120 after a pre-determined amount of money is spent in the casino. In an alternate embodiment, the credit building system 160 builds and stores a refundable credit 161 on the database 120 after a pre-determined amount of money is transferred from the casino in the form of winnings. In one embodiment, the voucher can include an accounting of the amount of money spent in the casino such that a calculation can be made by the application 100 as to whether the pre-determined amount of money spent at the casino has been achieved. Each time the pre-determined amount of money spent is achieved, a refundable credit 161 can be earned and applied to a credit account tied to the patron. Such a credit 161 can be incrementally added to patron's credit account by the database 120. In such a manner, a patron spending large sums of money in the casino can be rewarded with either a refund of a certain amount of money, as determined by the number of refundable credits, or other benefits such as food, drink, lodging, shows, or the like. Although the present disclosure is written with a casino in mind, other service providers 180 such as hotels, restaurants, sporting events, and the like are also contemplated.

In one embodiment, the application 100 further comprises a travel point system 170, wherein the travel point system 170 builds and stores a travel credit 171 on the database 120 after a pre-determined amount of money is spent in the casino. In an alternate embodiment, the travel credit system 170 builds and stores a travel credit 171 on the database 120 after a pre-determined amount of money is transferred from the casino in the form of winnings. In one embodiment, the voucher can include an accounting of the amount of money spent in the casino such that a calculation can be made by the application 100 as to whether the pre-determined amount of money spent at the casino has been achieved. Each time the pre-determined amount of money spent is achieved, a travel credit 171 can be incrementally added to the database 120. The travel credits 171 are redeemable for transportation tickets. In one embodiment, the transportation tickets are airplane tickets. One of ordinary skill in the art will understand that other types of transportation carriers 190 are contemplated, and that associated tickets to the transportation carriers 190 are also contemplated by the present disclosure such as train tickets, subway tickets, rental car vouchers, and the like which can be exchanged for transportation for the user.

Figure 2:
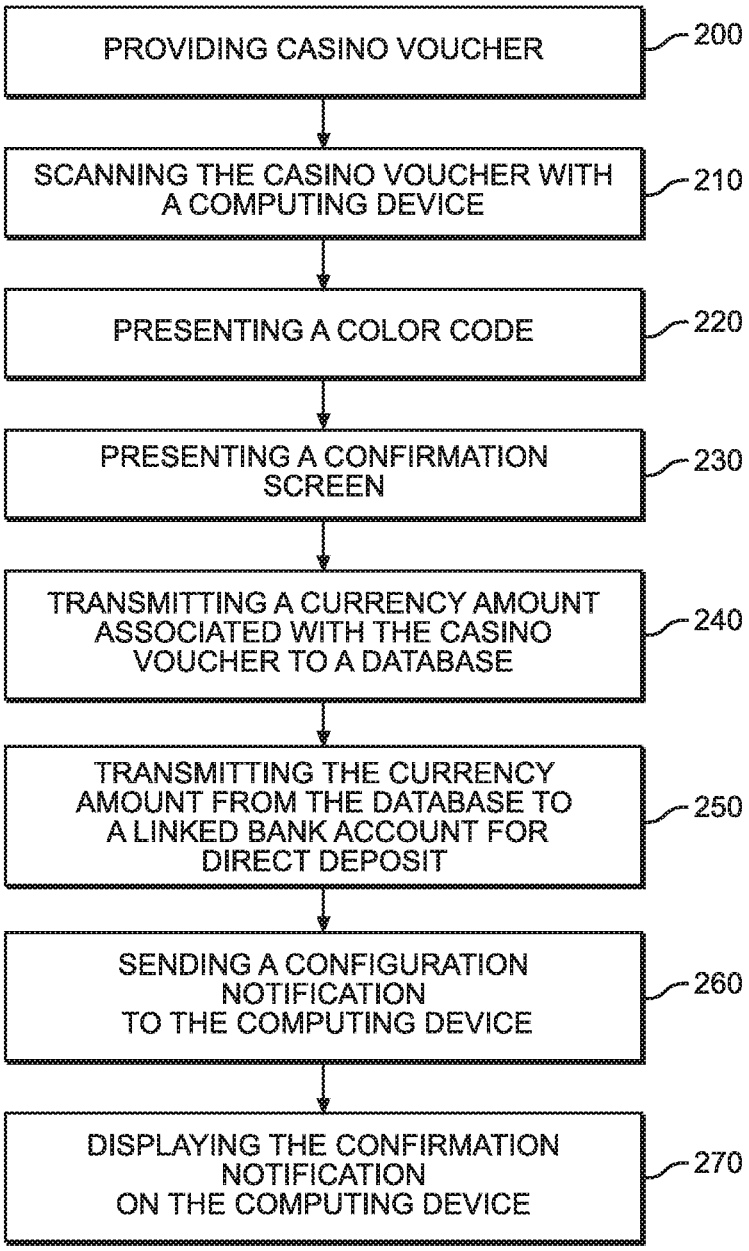
FIG. 2 shows a flow chart of an embodiment of the method of redeeming casino vouchers.

Referring now to FIG. 2, there is shown a flow chart of an embodiment of the method of redeeming casino vouchers. In one embodiment of the method of redeeming casino vouchers, a currency amount associated with a casino voucher is directly deposited to a paired bank account. The contemplated embodiment comprises the first steps of providing a casino voucher 200. One of ordinary skill in the art will understand that upon a patron winning a minimum amount in a casino, that casino will issue a voucher to the patron for reimbursement. The voucher has identifying characteristics such as a unique identifier and in some embodiments the currency amount won. The next step of the method is scanning the casino voucher with a computing device 210. As discussed previously, the computing device can scan the voucher through utilization of a camera or other hardware that is already installed on the computing device. Upon scanning the casino voucher, the data is input into an application. In one embodiment, the method comprises the additional step of the application communicating with a database to determine if the voucher has already been redeemed. The application then presents a color code 220 via a display of the computing device to communicate its determination of redemption status. For example, if the voucher has been redeemed, the application displays a red code via the computing device display. In another example, if the voucher has not been redeemed, the application displays a green code via the computing device display. In another embodiment, the method comprises the additional step of presenting a confirmation screen 230. The application can display the value of the voucher, via the display, to the patron and await confirmation that the patron would like to redeem the voucher. Upon a positive input being input to the computing device by the patron, the computing device enables the application to deposit the casino voucher directly into a bank account via the database. Such a direct deposit commences with transmitting a currency amount associated with the casino voucher to a database 240. The method continues by transmitting the currency amount from the database to a linked bank account for direct deposit. In one embodiment, a confirmation notification is sent to the computing device 260 for display to the patron. In an alternate embodiment, the confirmation notification is sent via text message to a paired phone number, email to a paired email account, or other similar forms of communication. In a further embodiment, display of the confirmation notification on the computing device 270 can be accomplished via the display of the computing device such that the patron receives confirmation of the transaction.

Figure 3:
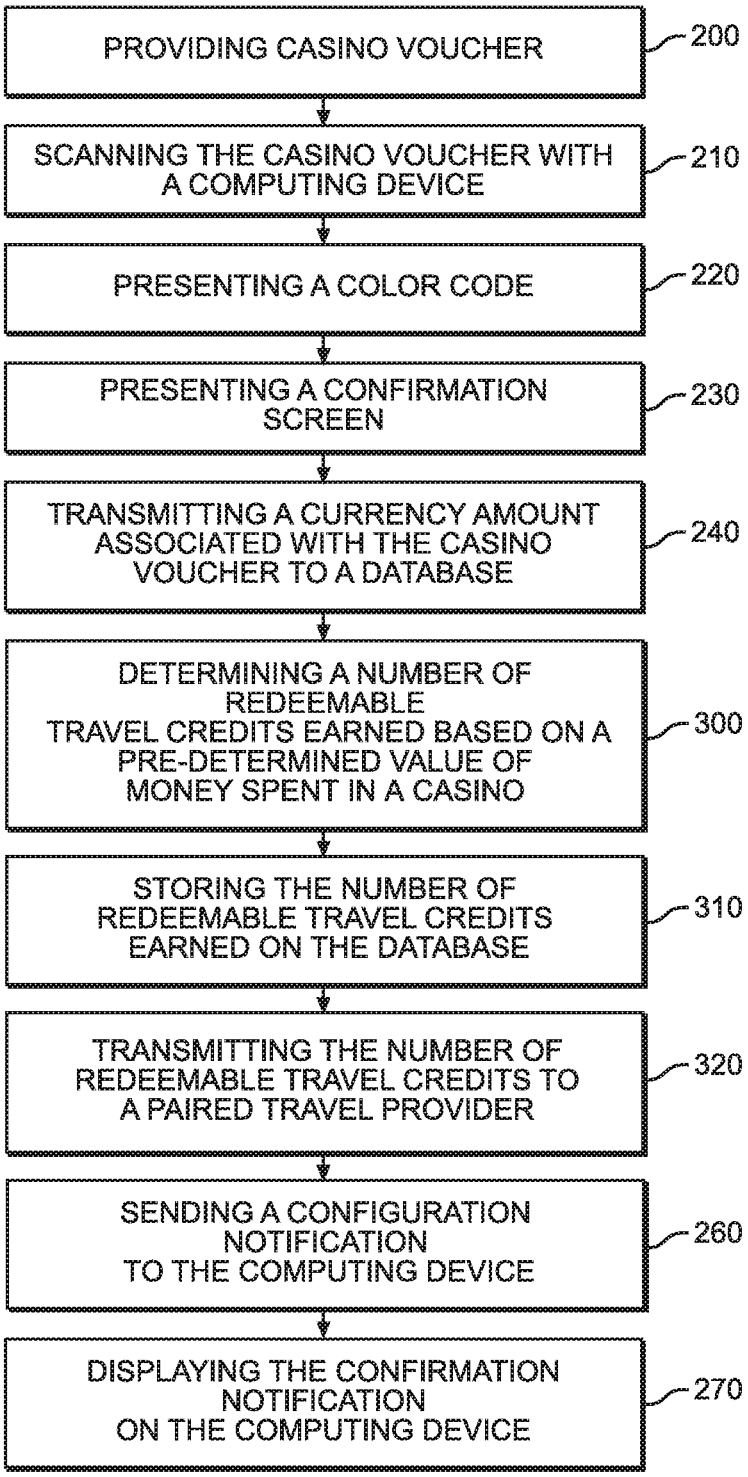
FIG. 3 shows a flow chart of an alternate embodiment of the method of redeeming casino vouchers with redeemable travel credits.

Referring now to FIG. 3, there is shown a flow chart of an alternate embodiment of the method of redeeming casino vouchers with redeemable travel credits. Such an embodiment comprises the same initial steps as directly depositing winnings discussed above by providing a casino voucher 200 and scanning the casino voucher with a computing device 210. In some embodiments, the method includes the further steps of presenting a color code 220. The method continues by transmitting a currency amount associated with the casino voucher to a database 230. The method of redeeming casino vouchers with redeemable travel credits continues by determining a number of redeemable travel credits earned based on a pre-determined value of money spent in the casino 300. In an alternate embodiment, the redeemable travel credits can be determined based on a pre-determined value of money wagered or risked in the casino, regardless of winning or losing said money. The number of redeemable travel credits earned is then stored on the database 310. The method continues by transmission of the number of redeemable travel credits to a paired travel provider 320 such as an airline, rental car agency, or the like. In a further embodiment, a confirmation notification can be displayed on the computing device 260, sent via a text message, email, or similar forms of communication. In one embodiment, the method also includes the step of displaying the confirmation notification on the computing device 270 such that the patron is notified of the number of credits earned, stored, and transmitted.

Figure 4:
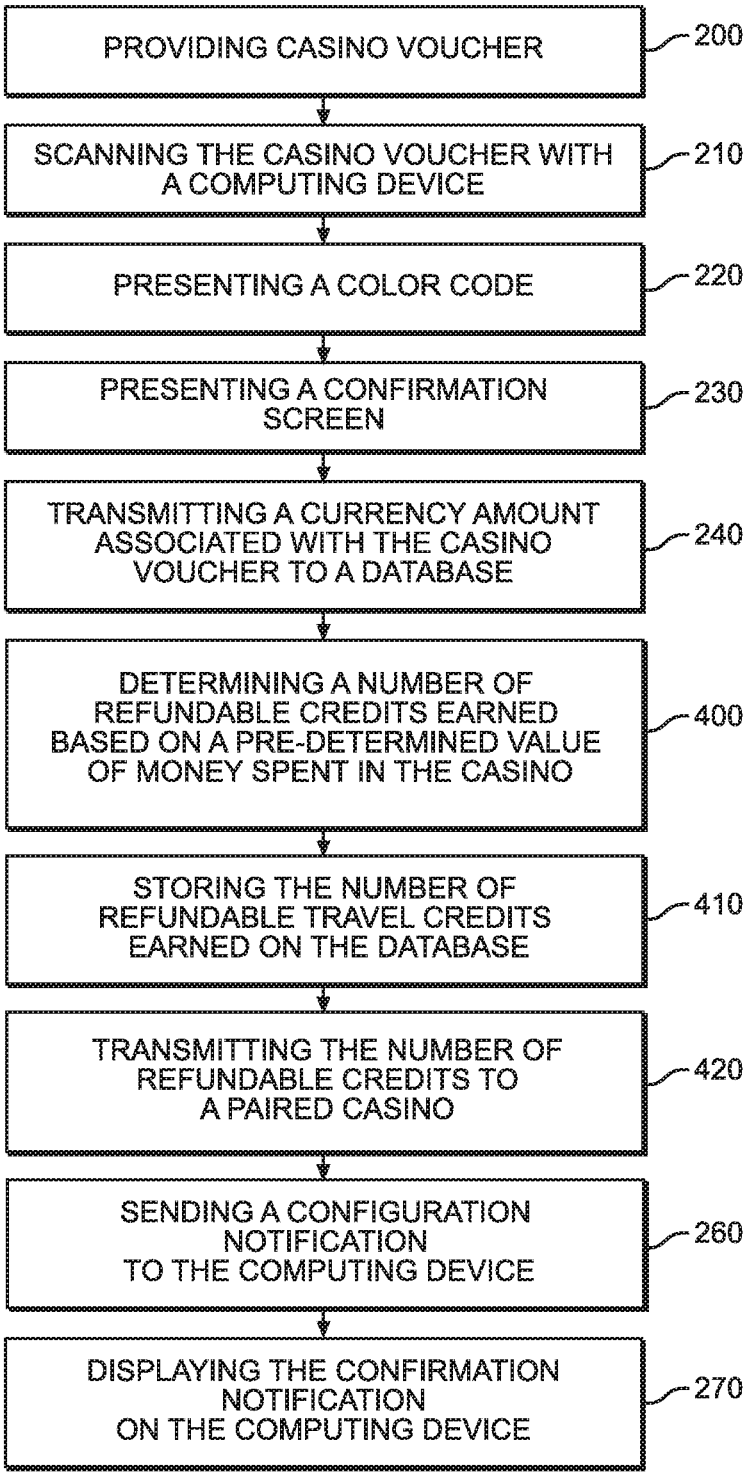
FIG. 4 shows a flow chart of an alternate embodiment of the method of redeeming casino vouchers with refundable credits.

Referring now to FIG. 4, there is shown a flow chart of an alternate embodiment of the method of redeeming casino vouchers with refundable credits. In an embodiment similar to the method of redeeming casino vouchers with redeemable travel credits, an alternate method comprises the steps of redeeming casino vouches with refundable credits. Such a method comprises the same steps of providing a casino voucher 200 and scanning the casino voucher with a computing device 210. In some embodiments, the method includes the further steps of presenting a color code 220. The method continues by transmitting a currency amount associated with the casino voucher to a database 230. The method of redeeming casino vouchers with refundable credits continues by determining a number of refundable credits earned based on a pre-determined value of money spent in the casino 400, in an alternate embodiment, the refundable credits can be determined based on a pre-determined value of money wagered or risked in the casino, regardless of winning or losing said money. The number of refundable credits earned is then stored on the database 410. The method continues by transmission of the number of refundable credits to a paired casino 420 or other service provider such as a hotel, restaurant, sporting event, or the like, in a further embodiment, a confirmation notification can be displayed on the computing device 260, sent via a text message, email, or similar forms of communication. In one embodiment, the method also includes the step of displaying the confirmation notification on the computing device 270 such that the patron is notified of the number of credits earned, stored, and transmitted.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An interactive casino system, comprising:

an application on a computing device in communication with a database;

the application configured to deposit a currency represented by at least one casino voucher directly into a bank account via the database;

the application further comprising an identification process;

the application further comprising a credit building system, wherein the credit building system builds and stores a refundable credit on the database after a pre-determined amount of money is spent in a casino;

the application further comprising a travel point system, wherein the travel point system builds and stores a redeemable travel credit on the database after a pre-determined amount of money is spent in the casino; and wherein the travel credits are redeemable for transportation tickets;

wherein a color code is presented on a display of the computing device;

wherein the color code indicates whether the voucher has been redeemed.

2. The interactive casino system of claim 1, wherein the computing device is selected from a group consisting of: a tablet, a cellphone, and a laptop computer.

3. The interactive casino system of claim 1, wherein the database is in communication with a paired bank account.

4. The interactive casino system of claim 1, wherein the transportation tickets are airplane tickets.

5. The interactive casino system of claim 1, wherein the identification process includes scanning a unique identifier of the casino voucher.

6. The interactive casino system of claim 1, wherein the identification process includes scanning a barcode of the casino voucher.

7. The interactive casino system of claim 1, wherein the application further comprises a confirmation screen, wherein a positive input from the computing device enables the application to deposit the casino voucher directly into the bank account via the database.

8. The interactive casino system of claim 7, wherein the positive input enables the application to send a confirmation notification to the display of the computing device.

* * * * *